United States Patent [19]

White, Jr.

[11] Patent Number: 4,582,485

[45] Date of Patent: Apr. 15, 1986

[54] BLAST FURNACE STOVE

[76] Inventor: Herbert A. White, Jr., 2516 Collins Rd., Pittsburgh, Pa. 15235

[21] Appl. No.: 701,399

[22] Filed: Feb. 13, 1985

[51] Int. Cl.[4] ..... F23L 9/04; F24H 1/00

[52] U.S. Cl. ..... 432/217; 432/30; 432/40; 431/170

[58] Field of Search ..... 432/40, 30, 70, 216, 432/217, 180, 181; 431/187, 188, 170, 173

[56] References Cited

U.S. PATENT DOCUMENTS

| | | | |
|---|---|---|---|
| 1,951,579 | 3/1934 | Pohl et al. | 432/217 |
| 3,550,918 | 12/1970 | Van Laar | 432/217 |
| 3,627,284 | 12/1971 | Van Laar | 432/217 |
| 3,642,262 | 2/1972 | Vroege | 432/30 |
| 3,690,627 | 9/1972 | Van Herk et al. | 432/40 |
| 3,837,793 | 9/1974 | Lucieer et al. | 432/217 |
| 3,891,384 | 6/1975 | Hovis et al. | 432/217 |
| 4,086,052 | 4/1978 | Laux et al. | 432/217 |
| 4,259,064 | 3/1981 | Laux et al. | 431/187 |
| 4,313,724 | 2/1982 | Muller | 432/217 |
| 4,353,688 | 10/1982 | Ahner et al. | 431/170 |
| 4,473,350 | 9/1984 | Gitman | 431/187 |

*Primary Examiner*—Henry C. Yuen

*Attorney, Agent, or Firm*—Martin J. Carroll

[57] ABSTRACT

The burner means for a blast furnace stove having a vertical shell, a combustion chamber adjacent the inside wall of the shell and checkers in the shell includes a generally horizontal first tube extending from the outside of the shell into communication with the combustion chamber, a ceramic tube within the first tube spaced therefrom, and a ceramic nozzle at the inner end of the ceramic tube extending upwardly at an angle between 45° and 90°. Air of fuel gas passes within the first tube around the ceramic tube and the other of the air or fuel passes within the ceramic tube with the gas and air mixing and burning upwardly in the combustion chamber.

2 Claims, 4 Drawing Figures

BLAST FURNACE STOVE

This invention relates to a blast furnace stove and more particularly to the heating means for such stoves. These stoves vary somewhat in design but basically are all structures having a steel shell surrounding a refractory vertical combustion chamber and at least one vertical checker chamber containing bricks which are heated by the combustion gasses for a short period and then cooled by the air being heated before going to the blast furnace. This flow reversal continues to take place at predetermined intervals. The burners used are generally of two types. The first design has a mechanical burner located outside the stove near the bottom of the combustion chamber. The air and blast furnace gas are mixed at the burner nozzle and are impelled horizontally into the combustion chamber where they are ignited by the hot target bricks of the combustion chamber wall as the mixture changes to a vertical direction. This side combustion type of burner as described in the Ninth Edition of Making, Shaping and Treating of Steel published by the United States Steel Corporation (Pages 427, 439 and 440) is the most common. The second introduces air and gas through a ceramic labyrinth in a vertical mode within the combustion chamber where it is mixed and ignited and burns as it passes through the combustion chamber. The first design has the disadvantage of damaging the target bricks and surrounding bricks because of abrasion and heat release. The second design is much more expensive to make and install and because of its location, maintenance costs are very high. Even minor repairs often require removal of the stove from operation for a prolonged period.

It is therefore an object of my invention to provide an inexpensive burner for a blast furnace stove that mixes and burns the combustion mixture in such a manner as to cause the least damage to the refractory of the stove while permitting ready and inexpensive repair of the burner.

This and other objects will be more apparent after referring to the following specification and attached drawings in which FIG. 1 is a vertical section of a stove showing the burner on an enlarged scale;

Figure 1:
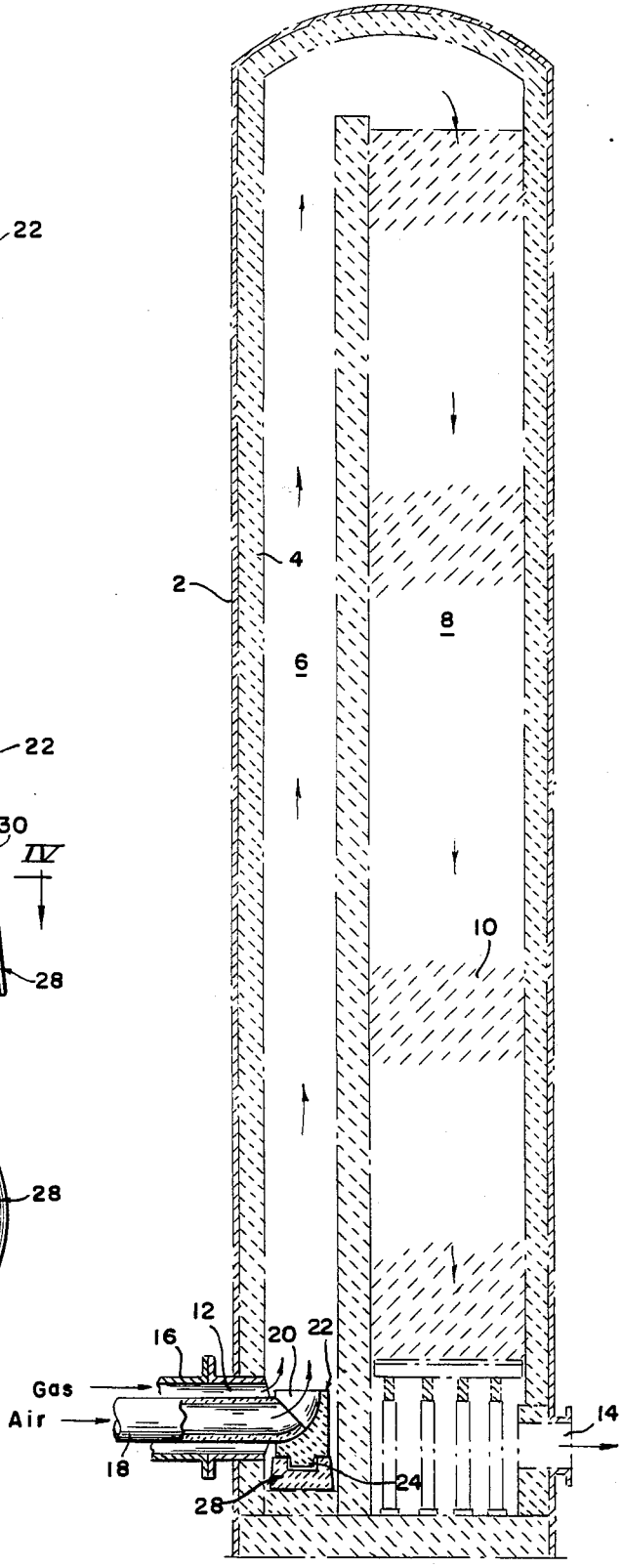
Figure 2:
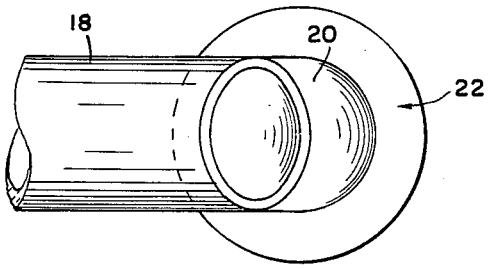
FIG. 2 is a plan view of the burner on an enlarged scale.
Figure 3:
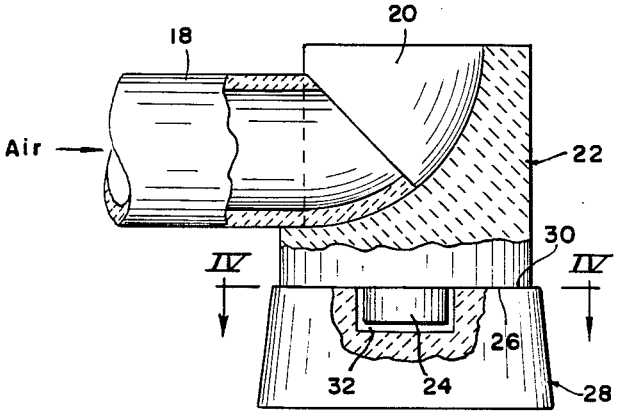
FIG. 3 is an elevation of the burner of FIG. 2, partly in section.
Figure 4:
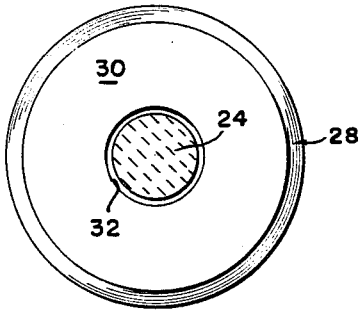
FIG. 4 is a view taken on line IV—IV of FIG. 3.

Referring more particularly to the drawings reference numeral 2 indicates the steel shell of the stove. The shell is lined with refractory brickwork 4 and the interior of the stove is divided into a refractory lined combustion chamber 6 and a regenerator or checker chamber 8 containing the checkers 10 consisting of bricks arranged with passages. There is an opening 12 at the bottom of the combustion chamber 6 and an opening 14 beneath the checkers 10. The parts so far described are conventional and it will be understood that the internal structure may vary both in size and construction.

According to my invention I provide a generally horizontal tube 16 attached to the shell 2 around opening 12 and a ceramic tube 18 generally coaxial with tube 16 extending into combustion chamber 6. A ceramic nozzle 20 is provided at the end of tube 18 and is shown extending upwardly at an angle of 90°. However, the angle may be as little as 45°. The nozzle at least in part, is part of a ceramic chair 22 having a lug 24 extending downwardly from its flat bottom surface 26. The chair 22 rests on a ceramic bench 28 which rests on the bottom of the combustion chamber 6 and has a flat top surface 30 with a socket 32 in the top surface for receiving lug 24. The horizontal dimensions of socket 32 are larger than those of the lug 24 so as to permit limited horizontal movement of the chair 22. While the chair 22 and the bench 28 may be unitary the two piece construction is preferable for several reasons. It is easier to install and decreases stress. Also since the vertical location of opening 12 with respect to the bottom of the combustion chamber 6 may vary from stove to stove, it is only necessary to provide a bench 28 of suitable height without any other changes. The bench and chair may be made of any suitable ceramic capable of standing thermal shock. A fired ceramic of 95° alumina is suitable.

In operation when the stove checkers 10 are being heated the tubes 16 and 18 are connected to sources of combustion air and combustion fuel which is blast furnace gas but of course other fuel could be used. In the drawings the air passes through tube 18 and the gas around tube 18, but the reverse may be used. It will be seen that the gas and the air are not mixed until they enter the combustion chamber where they ignite due to the heat of the chamber wall. The products of combustion pass upwardly through checker chamber 8 and pass down through the checkers 10 to heat the bricks before passing out through opening 14. After the bricks are heated the flow is reversed in the usual way with air entering through opening 14 and being heated in the checkers before passing out of the stove to the blast furnace.

While one embodiment of my invention is shown and described it will be apparent that other modifications and adaptations may be made within the scope of the following claims.

I claim:

1. In a blast furnace stove having a vertical shell, a vertical combustion chamber adjacent the inside wall of said shell, checkers in said shell, and burner means for supplying fuel gas and combustion air to said combustion chamber; the improvement in said burner means comprising a generally horizontal first tube extending from outside of said shell into communication with said combustion chamber, a ceramic tube within said first tube with its outer wall spaced from the inner wall of said first tube and a ceramic nozzle at the inner end of said ceramic tube extending upwardly at an angle between 45° and 90° one of said gas and air passing around said ceramic tube within said first tube and the other of said gas and air passing through said ceramic tube and nozzle, a ceramic chair, said nozzle being part of said chair, a ceramic bench resting on the floor of said combustion chamber and its top surface receiving the bottom surface of said chair, a downwardly extending lug on the bottom of said chair, and a socket in the top surface of said bench for receiving said lug and having larger horizontal dimensions than said lug to permit limited horizontal movement of said chair with respect to said bench.

2. In a blast furnace stove having a vertical combustion chamber adjacent the inside wall of said shell, checkers in said shell, and a burner means for supplying fuel gas and combustion air to said combustion chamber; the improvement in said burner means comprising a generally horizontal first tube extending from outside of said shell into communication with said combustion chamber, a ceramic tube within said first tube with its outer wall spaced from the inner wall of said first tube, a ceramic nozzle at the inner end of said ceramic tube extending upwardly at an angle between 45° and 90°, the top of said nozzle terminating substantially no higher than the top of said outer tube, one of said gas and air passing around said ceramic tube within said first tube and the other of said gas and air passing through said ceramic tube and nozzle, said outer tube having a discharge end adjacent said nozzle so that said gas and air are mixed and will burn in said combustion chamber, a ceramic chair, said nozzle being part of said chair, a ceramic bench resting on the floor of said combustion chamber and its top surface receiving the bottom surface of said chair, a vertical lug extending from one of said surfaces into a socket in the other of said surfaces, said socket having larger horizontal dimensions than said lug to permit limited horizontal movement of said chair with respect to said bench.

* * * * *